US005843210A

United States Patent [19]

Paranjpe et al.

[11] Patent Number: 5,843,210

[45] Date of Patent: Dec. 1, 1998

[54] METHOD AND APPARATUS FOR REMOVING PARTICULATES FROM A GAS STREAM

[75] Inventors: Prabhakar D. Paranjpe; Michael L. Ketcham, both of Chesterfield; David A. Berkel, Wildwood, all of Mo.

[73] Assignee: Monsanto Company, St. Louis, Mo.

[21] Appl. No.: 772,149

[22] Filed: Dec. 19, 1996

[51] Int. Cl.[6] ..... B03C 3/80

[52] U.S. Cl. ..... 95/59; 95/71; 96/27; 96/50; 96/53

[58] Field of Search ..... 95/59, 71, 72, 95/74; 96/27, 50, 52, 53, 74, 97

[56] References Cited

U.S. PATENT DOCUMENTS

| | | | |
|---|---|---|---|
| 2,302,185 | 11/1942 | Campbell, Jr. | 239/707 |
| 3,729,898 | 5/1973 | Richardson | 261/116 X |
| 3,960,505 | 6/1976 | Marks | 96/53 X |
| 3,988,128 | 10/1976 | Hogg | 55/270 X |
| 4,095,962 | 6/1978 | Richards | 361/227 X |
| 4,169,714 | 10/1979 | Calvert | 55/337 X |
| 4,190,875 | 2/1980 | Smart et al. | 361/228 |
| 4,193,774 | 3/1980 | Pilat | 55/227 X |
| 4,194,888 | 3/1980 | Schwab et al. | 96/97 X |
| 4,266,951 | 5/1981 | Calvert | 261/118 X |
| 4,345,916 | 8/1982 | Richards et al. | 55/223 X |
| 4,435,190 | 3/1984 | Taillet et al. | 96/27 X |
| 4,541,844 | 9/1985 | Malcolm | 95/64 |
| 4,908,047 | 3/1990 | Leonard | 96/52 X |
| 4,979,968 | 12/1990 | Jido | 96/27 |
| 5,147,421 | 9/1992 | Yung | 55/228 X |
| 5,268,011 | 12/1993 | Wurz | 55/440 X |
| 5,308,589 | 5/1994 | Jung | 96/53 X |
| 5,391,220 | 2/1995 | Patterson | 95/69 |
| 5,417,920 | 5/1995 | Jung | 95/64 X |

FOREIGN PATENT DOCUMENTS

| | | |
|---|---|---|
| 2101249 | 3/1972 | France . |
| 2139300 | 2/1972 | Germany . |
| 2243926 | 3/1974 | Germany . |
| 2355038 | 5/1975 | Germany . |
| 726352 | 4/1980 | U.S.S.R. . |
| 1287942 | 2/1987 | U.S.S.R. . |

OTHER PUBLICATIONS

Filters and Dust Collectors by Stuart A. Hoenig, P.E., Ph.D.; dated Nov./Dec. 1993; pp. 26–28.

Electrostatic Spraying by Binks, Training Division; dated Apr. 1988; pp. 1–8.

*Primary Examiner*—Richard L. Chiesa

*Attorney, Agent, or Firm*—Senniger, Powers, Leavitt & Roedel

[57] ABSTRACT

Electrostatic spray apparatus including an electrode for generating a high-voltage corona, one or more sprayers for generating a spray of liquid droplets and for directing the droplets into the high-voltage corona whereby an electrical charge is imparted to the droplets. The conduit which supplies the liquid to the sprayers is electrically grounded so that liquid supplied to the sprayer device is at ground potential. The electrode is continuously maintained substantially clean and dry as it generates the high-voltage corona. A process for removing particulates from a gas stream is also disclosed.

32 Claims, 5 Drawing Sheets

142
140
120
32
60
156
158
154
40
22
150
166
80
82
160
152
124
164
162
70
30
70
130
132
163
136
134

METHOD AND APPARATUS FOR REMOVING PARTICULATES FROM A GAS STREAM

BACKGROUND OF THE INVENTION

This invention relates generally to particle collectors and, more particularly, to electrostatic spray apparatus which can be used to increase the efficiency of particle collection systems.

The use of electrically charged liquid to remove particles of dirt from a gas stream is well known. Since dirt particles are charged, exposing the particles to oppositely charged droplets of water, for example, will cause the dirt particles and the water droplets to clump or agglomerate, thus making the collection process more efficient. The application of this principle to increase the efficiencies of wet scrubber systems has been the subject of study.

Different types of electrostatic spraying systems have been developed for imparting an electrical charge to liquid droplets before introducing them into a gas stream. These systems include induction charging systems, such as shown in U.S. Pat. No. 4,190,875 assigned on its face to The Ritten Corporation, Ltd., direct/corona charging systems, such as a system made by Binks Manufacturing Company of Franklin Park, Ill., spinning cup induction charging systems, and rotational atomizer induction charging systems of the type also made by Binks Manufacturing Company. While all of these systems have useful applications, they have certain drawbacks. Some are complex with moving mechanical parts and thus expensive to make and maintain; some have inherent safety risks; and all are difficult to use in cleaning certain types of gas streams, particularly streams of dusty wet gas.

SUMMARY OF THE INVENTION

Among the several objects of the present invention is the provision of electrostatic spray apparatus which can be manufactured at low capital cost; the provision of such apparatus which is very efficient in cleaning dusty wet gas; the provision of such apparatus which uses a supply of spray liquid which is maintained at ground electric potential for safer operation and elimination of the need to electrically isolate the supply; the provision of such apparatus which uses direct corona charging to impart the maximum electrical charge to the liquid droplets; the provision of such apparatus which has a minimum of moving mechanical parts and which is self-cleaning for reducing maintenance costs; the provision of such apparatus which has low operating costs; the provision of such apparatus which can be incorporated in a collection system to increase the efficiency of conventional particle collection devices (e.g., scrubbers and fiber bed mist eliminators) without increasing the system pressure drop; and the provision of an improved process for removing particulates from a gas stream using electrostatic spray apparatus having the advantages discussed above.

Generally, electrostatic spray apparatus of the present invention comprises an electrode for generating a high-voltage corona, spray means for generating a spray of liquid droplets adapted to be directed into said high-voltage corona whereby an electrical charge is imparted to the droplets, liquid conduit means for supplying liquid to said spray means, means for electrically grounding said liquid conduit means so that liquid supplied to said spray means is at ground potential, and means for continuously maintaining said electrode substantially clean and dry as it generates said high-voltage corona.

The present invention is also directed to a particle collection system which incorporates the above-described electrostatic spray apparatus. In this system a particle collecting device is disposed in a stream of dirty gas for removing particles of dirt from the gas stream, and the electrostatic spray apparatus of the present invention is provided upstream from the collecting device for generating electrically charged liquid droplets. These droplets are introduced into the gas stream to cause agglomeration of liquid droplets and particles of dirt for the purpose of increasing the efficiency of the downstream particle collecting device.

This invention is also broadly directed to a process for removing particulates from a gas stream. This process comprises the following steps: mounting an electrode adjacent said gas stream; delivering high-voltage electrical current to the electrode for generating a high-voltage corona; directing a spray of liquid droplets at ground electrical potential into the high-voltage corona to impart an electrical charge to the droplets; continuously maintaining the electrode substantially clean and dry as the liquid droplets are directed into the high-voltage corona; and introducing said charged liquid droplets into said gas stream.

Other objects and features of this invention will be in part apparent and in part pointed out hereinafter.

BRIEF DESCRIPTION OF THE DRAWINGS

Corresponding parts are designated by corresponding reference numbers throughout the several views of the drawings.

DESCRIPTION OF THE PREFERRED EMBODIMENT

Figure 1:
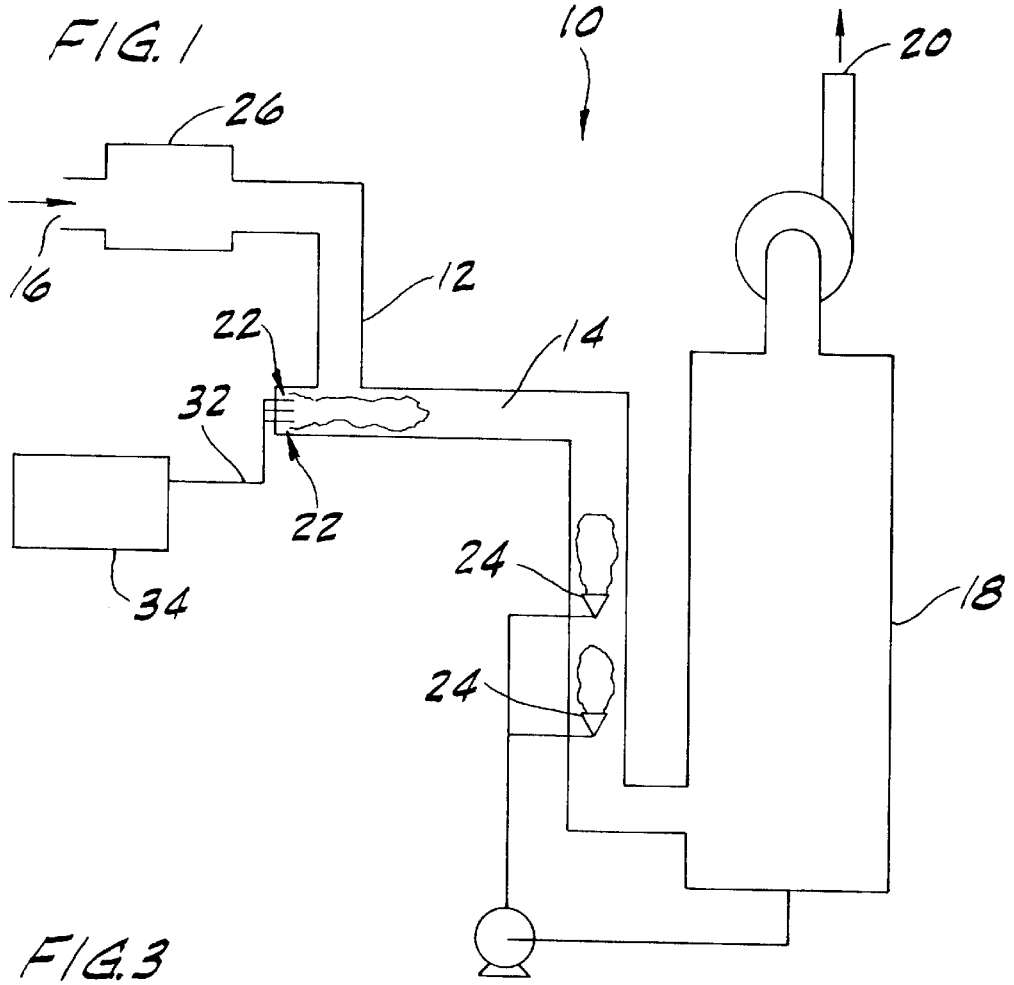
FIG. 1 is a schematic of an overall particle collection system incorporating the unique electrostatic spray apparatus of the present invention.

Referring now to the drawings, and first to FIG. 1, a particle collection system incorporating the present invention is designated in its entirety by the reference numeral 10. The system 10 comprises suitable means 12 (piping, ductwork, a stack, etc.) defining a passage 14 having an inlet 16 for receiving a stream of gas and directing it to a particle collector 18 which functions to remove particulates (e.g., particles of dirt) from the gas. This collector 18 may be a conventional scrubber, or fiber bed mist eliminator, or other particle collecting device having an outlet 20. The system 10 includes one or more electrostatic spray apparatus of the present invention, each generally designated 22, upstream from the collector 18 for generating electrically charged liquid droplets for introduction into the gas stream to cause agglomeration (clumping) of the charged droplets and the aforesaid particulates thereby to increase the efficiency of the particle collecting device 18. Optionally, if the collector 18 is a Dyna Waves® scrubber made and sold by Enviro-Chem Systems, a subsidiary of Monsanto Company, one or more Dyna Waves® reverse jets 24 are provided upstream of the collector between the electrostatic spray apparatus 22 and the collector 18. These reverse jets 24 spray liquid into the gas stream in a direction opposite the direction of gas flow. The operation of these jets 24 is well-known to those skilled in this field. If desired, suitable means 26 may also be provided adjacent the inlet of the passage upstream from the electrostatic spray apparatus for imparting an electrostatic charge to the particulates in the gas stream. It will be understood, however, that this means 26 is not essential to the present invention, since particles in the gas stream typically have an inherent electrical charge. (By increasing this charge, however, means 26 may serve to increase the efficiency of the system.)

Figure 2:
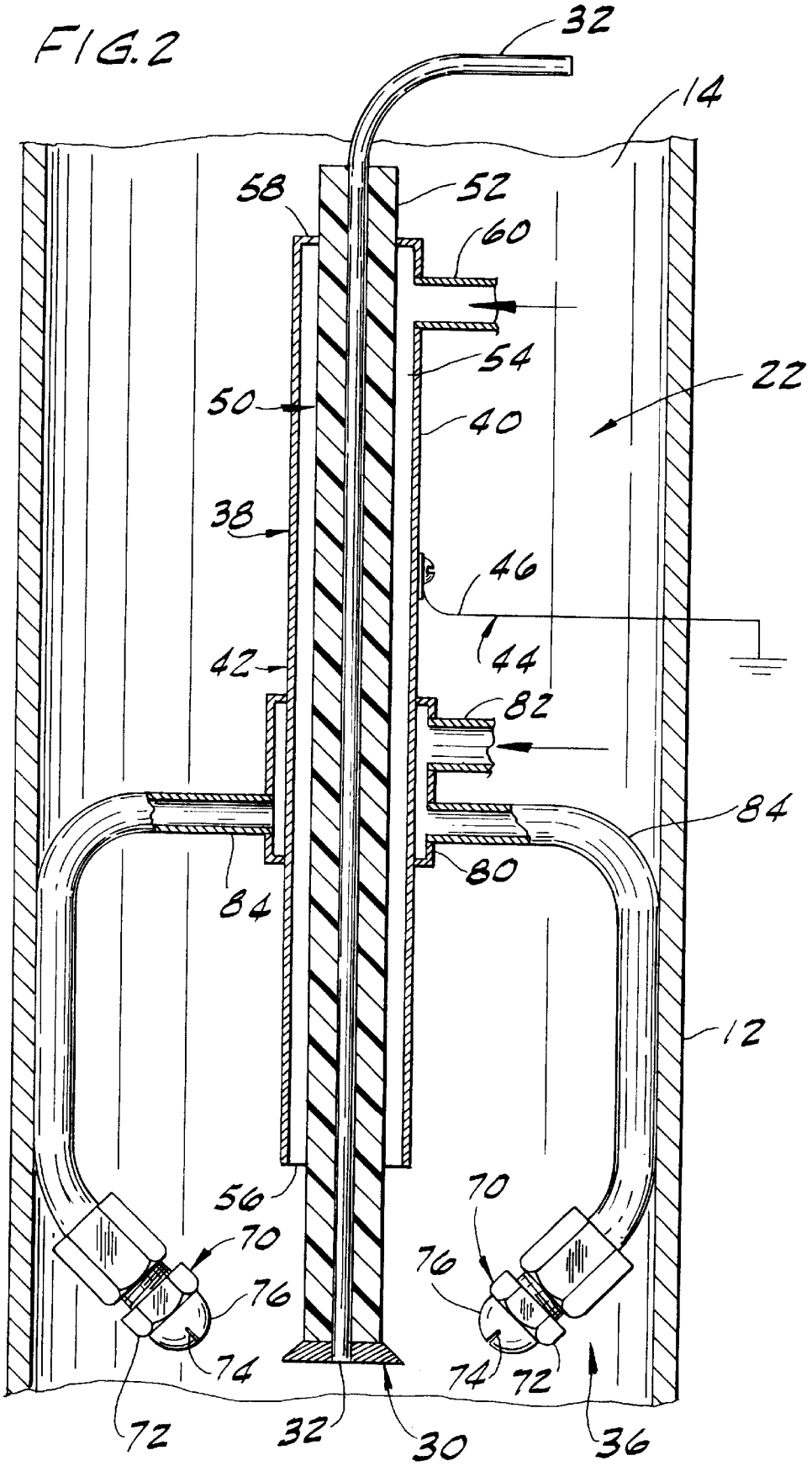
FIG. 2 is a diagrammatic longitudinal cross-section of the electrostatic spray apparatus of FIG. 1.

As shown best in FIG. 2, the electrostatic spray apparatus 22 of the present invention comprises an electrode, generally indicated at 30, for generating a high-voltage electrical corona, a conductor 32 connected to a high-voltage power supply 34 (FIG. 1) for delivering high-voltage electrical current to the electrode, and spray means, generally designated 36, for generating a spray of liquid droplets and for directing the droplets into the corona generated by the electrode 30 whereby an electrical charge is imparted directly to the droplets. Apparatus 22 also includes a gas conduit means, generally designated by 38, comprising a gas conduit 40 for directing high-velocity pressurized gas over and around the electrode for continuously maintaining the electrode substantially clean and dry, and liquid conduit means, generally indicated at 42, for supplying liquid (e.g., water) from a suitable source to the spray means 36. Means, generally designated by 44, comprising a ground wire 46 connected to the gas conduit 40 is also provided for grounding the liquid conduit means 42 so that liquid supplied to the spray means 36 is at ground potential.

The conductor 32 to the electrode 30 is axially (preferably coaxially) disposed within the gas conduit 40 inside an insulator, generally indicated at 50, comprising a sleeve 52 of suitable material (e.g., ceramic or other insulator) which electrically insulates the conductor 32 from the gas conduit 40 and liquid conduit means 42. The sleeve 52 and the gas conduit 40 are spaced from one another to provide an annular gap 54 therebetween through which a pressurized gas such as air is adapted to flow in a forward direction and at a relatively high velocity toward the electrode 30, the latter of which is spaced a relatively short distance forward from the open outlet end 56 of the gas conduit 40. The rearward end 58 of the gas conduit 40 is closed around the sleeve 52, and an inlet 60 is provided adjacent the rearward end of the conduit for entry of pressurized gas into the gas conduit 40 where it forms an annular column of purge gas which is directed at high-velocity (preferably about 30–100 feet per second) over and around the electrode 30. While the velocity of the gas is high, the volume required is relatively small because of the annular design. For example, a rate of about 5 cfm has been found to be suitable. The flow of gas serves three purposes, i.e., to keep the insulator 50 clean in a dirty environment, to keep the electrode 30 clean and dry, and to serve as a carrier for carrying the liquid droplets charged by the corona toward a location where the droplets can be injected into the gas stream in passage 14.

Spray means 36 comprises a plurality of spray nozzles (e.g., four nozzles each generally designated 70) spaced at suitable (e.g., 90 degree) intervals around the electrode. Each nozzle 70 is a liquid spray nozzle having a spray head 72 with a suitable orifice or orifices 74 configured for generating a spray of liquid droplets having diameters preferably between about 20 and about 500 micrometers, and for directing the droplets into the corona surrounding the electrode 30. The preferred spray pattern is a flat spray, but other patterns are possible. Each spray head 72 preferably has a smooth rounded surface 76 facing the electrode 30 for minimizing the risk of electrical arcing between the spray head and the electrode. The spray heads 72 should be mounted as close as possible to the electrode 30 (preferably less than 1.0 inch, and more preferably about 0.875 in.) to insure that a maximum electrical charge is imparted to the spray droplets, but the spacing should be such that there is no arcing between the electrode and the spray heads. Suitable nozzles 70 are commercially available from various sources, such as Spraying Systems Co. in Illinois, selling such nozzles under trade designations HVV-1/8 650033 and HVV-1/8 650067. Preferably the spray heads on these nozzles are rounded as previously described.

Spray means 36 further comprises an annular manifold 80 attached to and surrounding the outer surface of the gas conduit, as illustrated in FIG. 2. The manifold 80 has an inlet 82 for receiving pressurized liquid, and a plurality of tubular conduits 84 connected to the manifold for delivering liquid from the manifold to respective spray nozzles 70 at a pressure of about 40–120 psig and a rate of about 65–450 ml/min per nozzle. Since the manifold 80, spray nozzles 70 and spray are all at ground potential, the system 10 is safer than prior systems where the nozzles are electrified. Moreover, the present system 10 eliminates the need to electrically insulate the supply of liquid. Although FIG. 2 illustrates the spray means as an annular manifold, the position of the spray nozzles with respect to the electrode is more important than the shape. Many alternate manifold shapes would be equally suitable.

Figure 3:
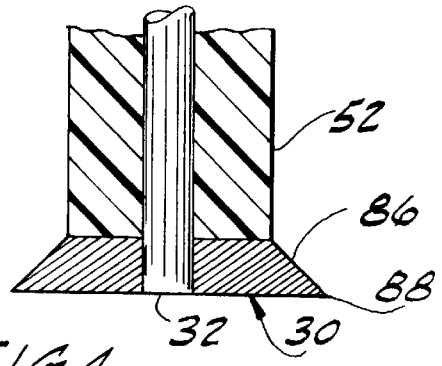
FIG. 3 is a sectional view showing portions of a conductor, insulator and electrode of the spray apparatus.
Figure 4:
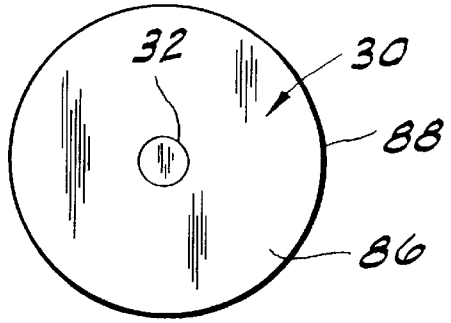
FIG. 4 is a front view of the electrode shown in FIG. 3.
Figure 6:
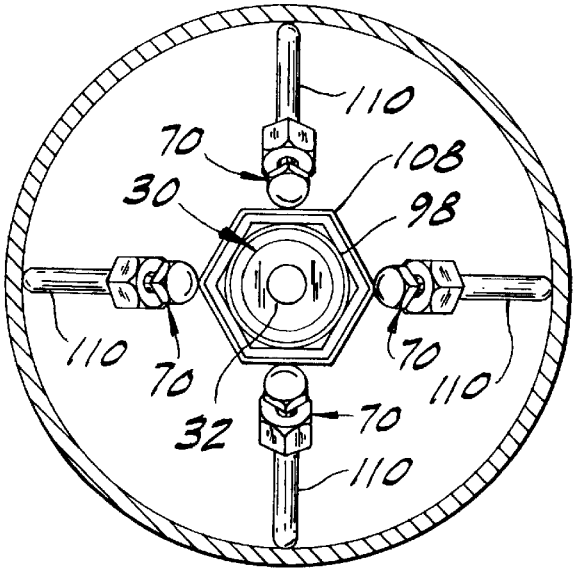
FIG. 6 is a front view of the electrostatic spray apparatus of FIG. 5.

The electrode 30 itself comprises an annular member 86 (FIG. 3) of stainless steel, for example, which is generally frusto-conical in shape. It is connected to the forward end of the conductor 32 and is generally coaxially disposed with respect to the conductor which delivers high-voltage current to the electrode. This current may be delivered at an amperage of about 200–1000 microamps, for example, and a voltage of about 14–20 kilovolts, for example. As shown best in FIG. 3, the annular member 86 tapers rearwardly from an outer edge 88 having a circular shape as viewed from the front (FIG. 4). The outer edge 88 is sharp to provide a steep voltage gradient for generating a strong electrical corona to provide the desired electrical charge (e.g., 1.1 E+07 electrons) to the spray droplets. The annular geometry is preferred over the use of a single discharge needle because a single needle has a very limited effective life. (During use, the needle corrodes and becomes dull, which reduces the current of the corona and results in less charging of the spray.) Electrodes having an annular geometry have a significantly longer effective life than needle electrodes.

Figure 5:
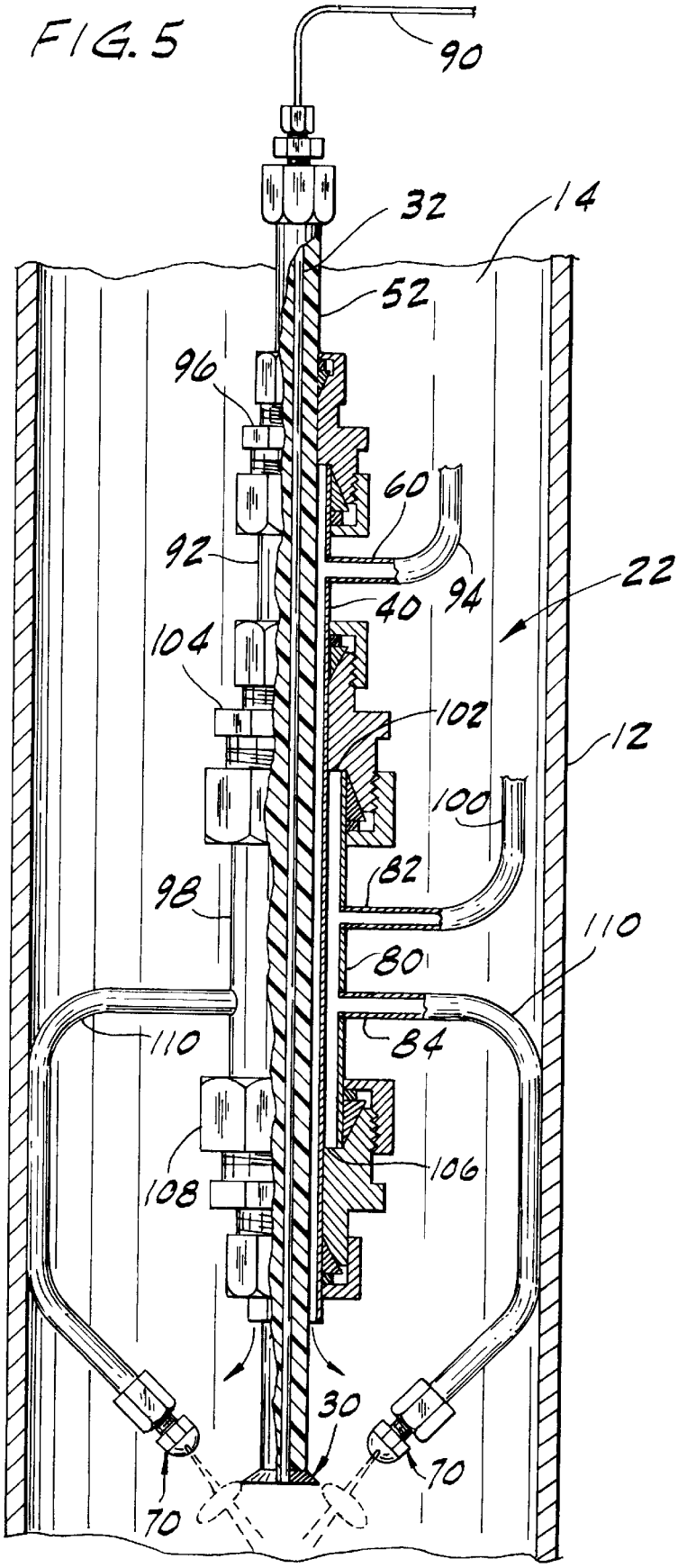
FIG. 5 is a view showing one way in which the spray apparatus may be fabricated.

FIG. 5 illustrates one way of fabricating the electrostatic spray apparatus 22 of the present invention, but it will be understood the apparatus may be made in other ways. As shown, electrical current is supplied to the conductor 32 by means of a high voltage power lead 90 connected to the power supply 34 (FIG. 1). The insulating sleeve 52 surrounding the conductor 32 is constructed from a ½ in. diameter teflon rod drilled to provide an axial bore therethrough. The gas conduit 40 is formed from a ¾ in. diameter stainless steel tubing 92 having a wall thickness of 0.035 in., and the inlet 60 to the gas conduit is fabricated from ¼ in.

diameter stainless steel tubing 94 welded to the gas conduit. The rearward (upstream) end 58 (FIG. 2) of the gas conduit 40 is closed by a Swagelok® stainless steel reducing union 96 which sealingly connects the gas conduit to the insulating sleeve 52. Swagelok is a U.S. federally registered trademark of Swagelok Co. of Solon, Ohio. The spray means manifold 80 is fabricated from 1 in. diameter stainless steel tubing 98 having a wall thickness of 0.035 in., and the water inlet 82 is formed from ¼ in. diameter stainless steel tubing 100 welded to the body. The rearward (upstream) end 102 of the manifold 80 is closed by a Swagelok® stainless steel reducing union 104 which sealingly connects the manifold and the gas conduit 40. The forward (downstream) end 106 of the manifold 80 is closed by a similar union 108 which also sealingly connects the manifold to the gas conduit 40. The tubular conduits 84 leading to the spray heads 72 (FIG. 2) are fabricated from ¼ in. stainless steel tubing 110 welded to the manifold 80. The spray apparatus 22 of this invention may be fabricated from different elements, using other materials and having other sizes.

Figure 7:
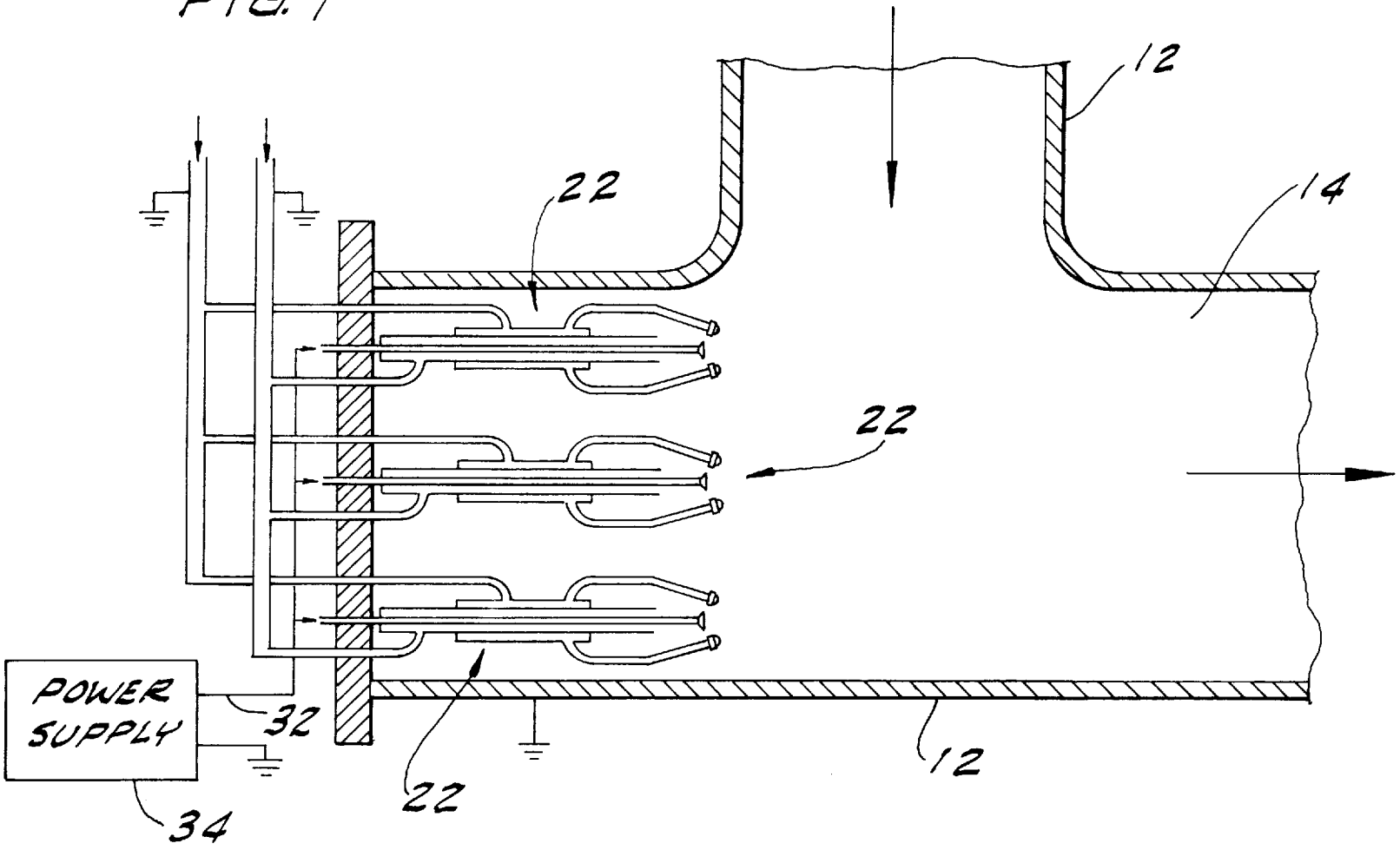
FIG. 7 is a diagrammatic view of a group of electrostatic spray apparatus as used in the overall particle collection system of FIG. 1.

Each spray apparatus 22 (three are shown in FIG. 7) is mounted by suitable means adjacent the passage 14 of the particle collection system 10 (FIG. 1) so that charged droplets of liquid are blown by the column of high-velocity purge gas into the stream of dirty gas moving through the passage. The charged liquid droplets can be injected in any direction relative to the flow of the gas stream. Any suitable number of spray apparatus 22 may be used, depending on the characteristics of the gas stream to be cleaned.

It will be understood from the foregoing that the spray apparatus 22 of the present invention can be used to carry out an improved process for removing particulates from a stream of gas moving through a passage (e.g., passage 14). In its broadest sense, this process involves the following steps: mounting an electrode (e.g., electrode 30 in FIG. 5) adjacent the stream of gas; delivering high-voltage electrical current to the electrode to generate a high-voltage electrical corona; directing a spray of liquid droplets at ground potential into the corona to directly impart an electrical charge to the droplets; continuously maintaining the electrode substantially clean and dry as the liquid droplets are directed into the corona; and introducing the charged liquid droplets into the gas stream. This causes the droplets and particulates of opposite charge to agglomerate or clump so that the particulate capture efficiency of a downstream collector (e.g., collector 18 in FIG. 1) is increased without increasing the overall pressure drop across the system (e.g., system 10). It is well known in the art that larger particles are much easier to collect.

The electrostatic spray apparatus 22 and process of the present invention have several advantages over conventional electrostatic spray systems. These advantages include: a simple design for low capital cost; direct corona charging for imparting maximum charge to the liquid droplets; no moving mechanical parts for minimizing mechanical problems; spray liquid is provided at ground electrical potential for safer operation and for avoiding any need to electrically isolate the liquid supply; self-cleaning operation for reducing maintenance costs; and low operating costs because the liquid spray nozzles (e.g., nozzles 70) require no air and the amount of purge air required is relatively low (e.g., about 5 cfm).

Figure 8:
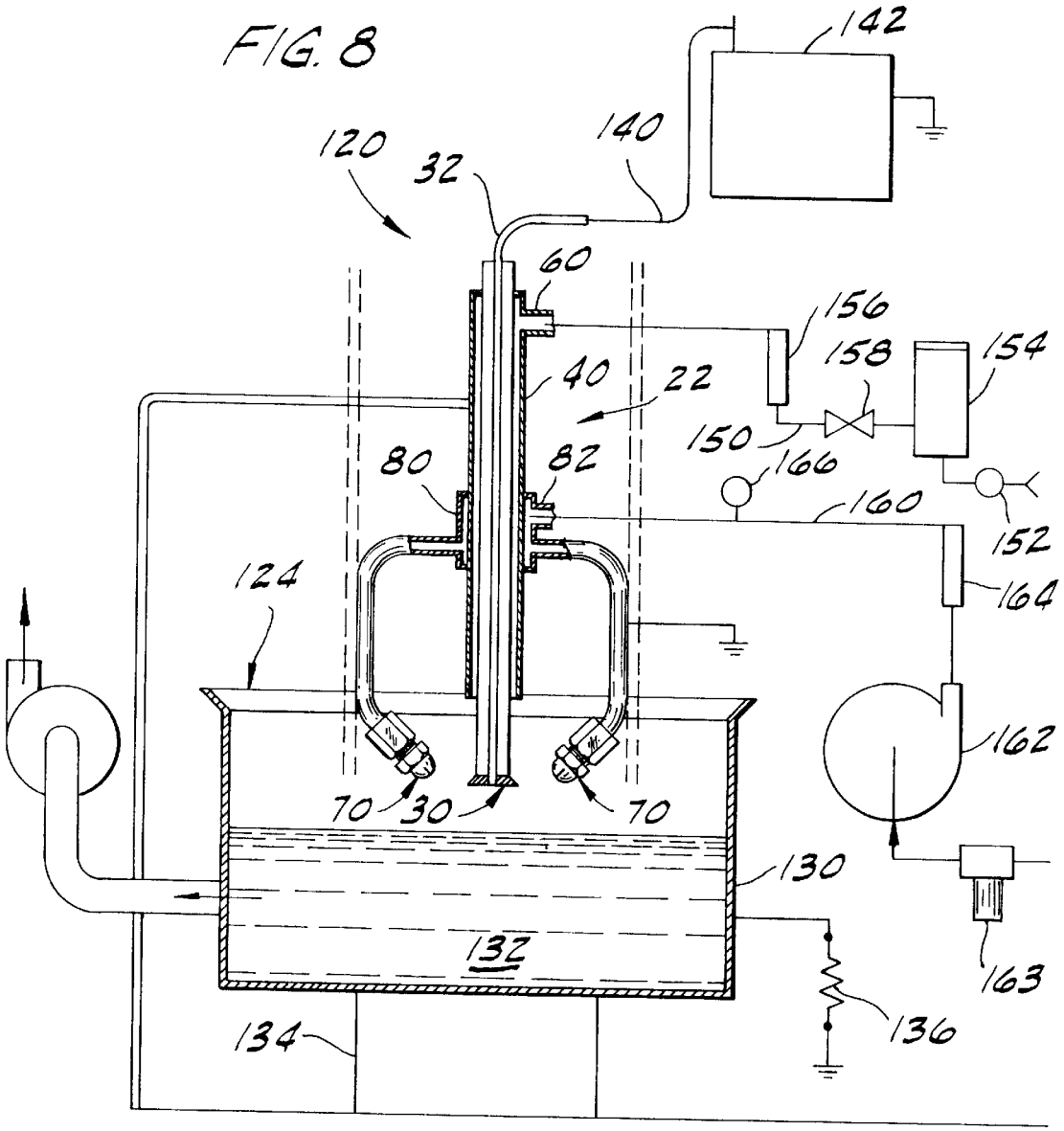
FIG. 8 is a diagrammatic view of a setup used to test electrostatic spray apparatus of the preferred embodiment.

To further illustrate and explain the invention, an example is now presented. A laboratory test was run using the apparatus shown in FIG. 8. The test apparatus, generally designated 120, comprised an electrostatic spray apparatus 22 mounted on a test stand 122 above a Faraday cage, generally indicated at 124. The cage 124 was a stainless steel bucket 130 packed with steel wool 132 so the droplets dispensed from the spray nozzles 70 of the spray apparatus 22 transferred their electrical charges to the bucket when they contacted the steel wool. To electrically insulate the cage 124 from surrounding equipment and ground, the cage 124 was positioned atop a plastic insulator 134. A 1.0 E+06 ohm resistor 136 connected the cage 124 to ground so the electrical charge of the captured droplets could be determined using a multimeter (not shown) connected in parallel with the resistor.

A high voltage wire 140 connected between the spray apparatus conductor 32 and a variable voltage power supply 142 supplied the apparatus 22 with electrical power. The gas manifold 40 of the spray apparatus 22 was connected to shop air by an air hose 150. A pressure regulator 152 and an air filter 154 provided along the air hose 150 regulated and cleaned the air delivered to the spray apparatus 22. A rotameter 156 positioned along the air hose 150, downstream from the air filter 154, measured the flow rate of air through the hose, and a needle valve 158 controlled the air flow rate supplied to the spray apparatus 22. A second hose 160 connected between a cold water source (not shown) and the spray manifold 80 delivered water to the spray apparatus 22. In addition, a pump 162 connected to the water hose 160 pressurized the water to force it through the spray nozzles 70. A water filter 163 located upstream from the pump 162 filtered the water delivered to the spray apparatus 22. A rotameter 164 installed downstream from the pump 162 measured the flow rate through the hose 160, and a pressure gage 166 installed downstream from the rotameter measured the pressure of water delivered to the spray apparatus 22. A grounding strap 172 grounded the spray apparatus 22 for safety.

As will be apparent to those of ordinary skill in the art, one or more test variables such as electrode type, distance between the spray nozzles 70 and the electrode 30, gas manifold 40 flow rate, water manifold 80 pressure, and/or electrode 30 voltage, may be altered using the previously described test apparatus 120 to study the affect changing the variable has on the charge density of the droplets emitted by the spray apparatus 22. Charge density is the average electrical charge of each water droplet per unit volume of gas passing the apparatus 22. Therefore, charge density is a measure of the ability of the apparatus 22 to agglomerate particles as they pass the apparatus. The higher the charge density, the more particles which are agglomerated and the higher the overall particulate capture efficiency of a downstream collector (e.g., collector 18 in FIG. 1).

A test was conducted using the previously described test apparatus 120. Throughout the test, the gas manifold flow rate was maintained at 280 scfh and the electrode 30 voltage was held at 17 KV. However, the gap size between the electrode 30 and the nozzles 40 and the water flow rate through the nozzles were independently varied. Table I shows the test results for 0.75 inch gaps between the electrode 30 and the nozzles 70, and Table II shows the results for 0.88 inch gaps between the electrode and the nozzles. The water flow rate through the manifold 80 was varied at each gap size and the voltage across the Faraday cage resistor 136 was measured using a multimeter. The voltage measurements are shown in the second column of the tables. From these voltage measurements, the charge densities shown in the third column of the tables were calculated. Although gas flowed past the apparatus 22 at a rate of 500 cfm during the tests, a 1000 cfm flow rate was used in calculating the charge densities to provide more typical values. As between the variables tested in Tables I and II, the 0.88 inch gap and 510 ml/min water flow rate were most desirable because they delivered the highest charge density.

TABLE I

Charge Density at Various Water Flow Rates for a 0.75 inch Gap between the Nozzles and Electrode (water flow rate and change density for four nozzles)

| Water Flow Rate (ml/min) | Voltage at Faraday Cage (V) | Charge Density (coul/m$^3$) |
|---|---|---|
| 510 | 5.2 | 1.1E-05 |
| 640 | 4.6 | 9.7E-06 |
| 700 | 4.2 | 8.9E-06 |
| 790 | 4.1 | 8.7E-06 |
| 850 | 4.0 | 8.5E-06 |

TABLE II

Charge Density at Various Water Flow Rates for a 0.88 inch Gap between the Nozzles and Electrode (water flow rate and change density for four nozzles)

| Water Flow Rate (ml/min) | Voltage at Faraday Cage (V) | Charge Density (coul/m$^3$) |
|---|---|---|
| 510 | 6.2 | 1.3E-05 |
| 640 | 5.4 | 1.1E-05 |
| 700 | 4.9 | 1.0E-05 |
| 790 | 4.4 | 9.3E-06 |
| 850 | 4.1 | 8.7E-06 |

As will be appreciated by those of ordinary skill in the art, other system parameters of the test apparatus 120 described above may be varied to determine the optimum parameters for removing particulates.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Electrostatic spray apparatus comprising an electrode for generating a high-voltage corona, spray means for generating a spray of liquid droplets directed into said high-voltage corona whereby an electrical charge is imparted to the droplets, an insulator for supporting the electrode so that said spray of liquid droplets is directed into the high-voltage corona, liquid conduit means for supplying liquid to said spray means, means for electrically grounding said liquid conduit means so that liquid supplied to said spray means is at ground potential, and means surrounding an outer surface of said insulator through which pressurized gas can be directed for continuously maintaining said electrode and insulator substantially clean and dry as the electrode generates said high-voltage corona and as the spray means directs said spray of droplets into the high-voltage corona.

2. Electrostatic spray apparatus as set forth in claim 1 wherein said means for continuously maintaining said electrode and insulator substantially clean and dry comprises gas conduit means for directing high-velocity pressurized gas over and around the electrode and insulator.

3. Electrostatic spray apparatus as set forth in claim 1 wherein said spray means comprises a plurality of spray nozzles disposed around said electrode.

4. Electrostatic spray apparatus as set forth in claim 3 wherein said spray nozzles are configured to generate flat spray patterns directed into said corona.

5. Electrostatic spray apparatus as set forth in claim 3 wherein said means for continuously maintaining said electrode and insulator substantially clean and dry comprises gas conduit means for directing high-velocity pressurized gas over and around the electrode and insulator, and said spray means further comprises a manifold attached to an outer surface of said gas conduit means, said manifold having an inlet for receiving pressurized liquid, and a plurality of conduits for delivering pressurized liquid from the manifold to said spray nozzles.

6. Electrostatic spray apparatus as set forth in claim 3 wherein each spray nozzle has a spray head mounted less than 1.0 in. from said electrode, said spray head having a smooth rounded surface adjacent the electrode for minimizing the risk of electrical arcing between the spray head and the electrode.

7. Electrostatic spray apparatus as set forth in claim 1 wherein said electrode comprises an annular member having a sharp rounded outer edge for providing a steep voltage gradient.

8. Electrostatic spray apparatus as set forth in claim 7 wherein said annular member is frusto-conical in shape.

9. Electrostatic spray apparatus as set forth in claim 1 wherein said electrode comprises an annular member at a forward end of said conductor, said annular member having a sharp rounded outer edge for providing a steep voltage gradient.

10. Electrostatic spray apparatus comprising an electrode for generating a high-voltage corona, spray means for generating a spray of liquid droplets directed into said high-voltage corona whereby an electrical charge is imparted to the droplets, liquid conduit means for supplying liquid to said spray means, means for electrically grounding said liquid conduit means so that liquid supplied to said spray means is at ground potential, means for continuously maintaining said electrode substantially clean and dry as it generates said high-voltage corona comprising gas conduit means for directing high-velocity pressurized gas over and around the electrode, a conductor for delivering high-voltage electrical current to said electrode, said conductor being axially disposed inside said gas conduit means, and a tubular insulator around the conductor for electrically insulating the conductor from said gas conduit means.

11. Electrostatic spray apparatus as set forth in claim 10 wherein said tubular insulator and said gas conduit means are spaced from one another to provide an annular gap therebetween through which said pressurized gas is adapted to flow in a forward direction toward said electrode.

12. Electrostatic spray apparatus as set forth in claim 11 wherein said gas conduit means has an open outlet end, and wherein said electrode is spaced forward of the open outlet end.

13. Electrostatic spray apparatus as set forth in claims 10 wherein said electrode comprises an annular member at a forward end of said conductor, said annular member having a sharp rounded outer edge for providing a steep voltage gradient.

14. Electrostatic spray apparatus as set forth in claim 13 wherein said annular member is frusto-conical in shape and generally coaxially disposed around said conductor.

15. A particle collection system comprising a particle collecting device disposed in a stream of dirty gas for removing particles of dirt from the gas stream, the improvement comprising electrostatic spray apparatus upstream from said particle removing device for generating electrically charged liquid droplets for introduction into said gas stream to cause agglomeration of said liquid droplets and particles of dirt thereby to increase the efficiency of the downstream particle collecting device, said electrostatic spray apparatus comprising an electrode for generating a high-voltage corona, spray means for generating a spray of liquid droplets directed into said high-voltage corona whereby an electrical charge is imparted to the droplets, an insulator for supporting the electrode so that said spray of liquid droplets is directed into the high-voltage corona, liquid conduit means for supplying liquid to said spray means, means for electrically grounding said liquid conduit means so that liquid supplied to said spray means is at ground potential, and means surrounding an outer surface of said insulator through which pressurized gas can be directed for continuously maintaining said electrode and insulator substantially clean and dry as the electrode generates said high-voltage corona and as the spray means directs said spray of droplets into the high-voltage corona.

16. A particle collection system as set forth in claim 15 wherein said means for continuously maintaining said electrode and insulator substantially clean and dry comprises gas conduit means for directing high-velocity pressurized gas over and around the electrode and insulator.

17. A particle collection system as set forth in claim 15 wherein said spray means comprises a plurality of spray nozzles disposed around said electrode.

18. A particle collection system as set forth in claim 17 wherein said spray nozzles are configured to generate flat spray patterns directed into said corona.

19. A particle collection system as set forth in claim 17 wherein said means for continuously maintaining the electrode and insulator substantially clean and dry comprises gas conduit means for directing high-velocity pressurized gas over and around the electrode and insulator, and said spray means further comprises a manifold attached to an outer surface of said gas conduit means, said manifold having an inlet for receiving pressurized liquid, and a plurality of conduits for delivering pressurized liquid from the manifold to said spray nozzles.

20. A particle collection system as set forth in claim 17 wherein each spray nozzle has a spray head mounted less than 1.0 in. from said electrode, said spray head having a smooth rounded surface adjacent the electrode for minimizing the risk of electrical arcing between the spray head and the electrode.

21. A particle collection system comprising a particle collecting device disposed in a stream of dirty gas for removing particles of dirt from the gas stream, the improvement comprising electrostatic spray apparatus upstream from said particle removing device for generating electrically charged liquid droplets for introduction into said gas stream to cause agglomeration of said liquid droplets and particles of dirt thereby to increase the efficiency of the downstream particle collecting device, said electrostatic spray apparatus comprising an electrode for generating a high-voltage corona, spray means for generating a spray of liquid droplets directed into said high-voltage corona whereby an electrical charge is imparted to the droplets, liquid conduit means for supplying liquid to said spray means, means for electrically grounding said liquid conduit means so that liquid supplied to said spray means is at ground potential, means for continuously maintaining said electrode substantially clean and dry as it generates said high-voltage corona comprising gas conduit means for directing high-velocity pressurized gas over and around the electrode, a conductor for delivering high-voltage electrical current to said electrode, said conductor being axially disposed inside said gas conduit means, and a tubular insulator for electrically insulating the conductor from said gas conduit means and said liquid conduit means.

22. A particle collection system as set forth in claim 21 wherein said tubular insulator and said gas conduit means are spaced from one another to provide an annular gap therebetween through which said pressurized gas is adapted to flow in a forward direction toward said electrode.

23. A particle collection system as set forth in claim 22 wherein said gas conduit means has an open outlet end, and wherein said electrode is spaced forward of the open outlet end.

24. A particle collection system as set forth in claim 21 wherein said electrode comprises an annular member at a forward end of said conductor, said annular member having a sharp rounded outer edge for providing a steep voltage gradient.

25. A particle collection system as set forth in claim 24 wherein said annular member is frusto-conical in shape and generally coaxially disposed around said conductor.

26. A process for removing particulate from a gas stream, said process comprising mounting an electrode adjacent said gas stream, delivering high-voltage electrical current to said electrode through a conductor surrounded by an insulator for generating a high-voltage corona, directing a spray of liquid droplets at ground electrical potential into said high-voltage corona to impart an electrical charge to the droplets, continuously maintaining outer surfaces of said electrode and insulator substantially clean and dry as said liquid droplets are directed into said high-voltage corona by directing a column of high-velocity purge gas over and around said electrode and insulator, and introducing said charged liquid droplets into said gas stream.

27. A process as set forth in claim 26 wherein said column of purge gas is generally annular in shape and moves at a velocity of about 30–100 feet per second.

28. A process as set forth in claim 26 wherein said purge gas is air.

29. A process as set forth in claim 26 wherein said liquid droplets are generated by one or more nozzles adjacent said electrode.

30. A process as set forth in claim 29 wherein said liquid droplets are greater than about twenty 20 micrometers in diameter.

31. A process as set forth in claim 26 wherein the high-voltage electrical current delivered to said electrode has an amperage of about 200 to about 1000 microamps and a voltage of about 14 to about 20 kilovolts.

32. A process as set forth in claim 26 wherein said electrode is mounted upstream from apparatus for removing particulates from the gas stream.

* * * * *